US008162502B1

(12) United States Patent
Zadro

(10) Patent No.: US 8,162,502 B1
(45) Date of Patent: Apr. 24, 2012

(54) ILLUMINATED CONTINUOUSLY ROTATABLE DUAL MAGNIFICATION MIRROR

(76) Inventor: Zlatko Zadro, Huntington Beach, CA (US)

( * ) Notice: Subject to any disclaimer, the term of this patent is extended or adjusted under 35 U.S.C. 154(b) by 396 days.

(21) Appl. No.: 12/454,865

(22) Filed: May 27, 2009

(51) Int. Cl.
*F21V 33/00* (2006.01)
*F21V 21/26* (2006.01)

(52) U.S. Cl. ..... 362/141; 362/413; 362/427

(58) Field of Classification Search ..... 362/135–144, 362/234, 249.03, 249.07, 249.1, 413, 427
See application file for complete search history.

(56) References Cited

U.S. PATENT DOCUMENTS

| | | | | | |
|---|---|---|---|---|---|
| 484,964 | A * | 10/1892 | Hill | ..... | 362/427 |
| 1,138,552 | A * | 5/1915 | Goddard | ..... | 362/141 |
| 3,435,199 | A * | 3/1969 | Ely | ..... | 362/141 |
| 3,936,671 | A * | 2/1976 | Bobrick et al. | ..... | 362/249.1 |
| 5,235,500 | A * | 8/1993 | Sapper | ..... | 362/427 |
| 5,690,420 | A * | 11/1997 | Saldana, Sr. | ..... | 362/427 |
| 5,997,149 | A * | 12/1999 | Chu | ..... | 362/142 |
| 6,273,585 | B1 * | 8/2001 | Wu | ..... | 362/135 |
| 7,048,406 | B1 * | 5/2006 | Shih | ..... | 362/135 |
| 7,393,115 | B2 * | 7/2008 | Tokushita et al. | ..... | 362/136 |

* cited by examiner

*Primary Examiner* — Alan Cariaso
(74) *Attorney, Agent, or Firm* — William L. Chapin

(57) ABSTRACT

A mirror for facilitating appearance related functions includes a circular ring-shaped frame holding therein back-to-back reflective mirror plates having different magnification factors, e.g. 1× and 5×, each plate having a circular central imaging reflective area and an outer concentric light transmissive window area. Continuously rotatable pivot joints support the frame between opposed arms of a yoke protruding upwardly from a stanchion and base for placement on a table, or an arm and wall bracket for mounting on a wall, enabling the frame to be rotated to interchangeably orient 1× and 5× mirror plates in a forward facing use position. A ring-shaped, printed circuit board with circumferentially spaced apart light emitting diodes (LED's) protruding radially outwards of an outer circumferential edge of the board is located between inner facing surfaces of the mirror plates. Illumination of objects in front of the mirror plates is effected by direct LED rays emitted forwardly through the light transmissive windows, and intensified by indirect LED rays reflected from reflective inner facing surfaces of the mirror plates. Electrical power is supplied to the LED's from a battery power supply in the base of the mirror by electrically conductive pins which protrude radially outwards from opposite sides of the frame, the pins being rotatably supported in electrically conductive cups located in opposed arms of the yoke, the cups being connected to the power supply via wires disposed through the yoke arms and stanchion to the power supply.

23 Claims, 9 Drawing Sheets

48
64
50
78
90
96
51
95
89
49
47
99
70
69
46
107
66
96A
98
97
95A
71
44
72
74
77
73
67
45
68
65
37
39
41
40
25
36
26
21
33

ILLUMINATED CONTINUOUSLY ROTATABLE DUAL MAGNIFICATION MIRROR

BACKGROUND OF THE INVENTION

A. Field of the Invention

The present invention relates to mirrors of the type used by people to facilitate performance of personal appearance related functions such as shaving, applying cosmetics and the like. More particularly, the invention relates to a versatile free-standing mirror which includes a base for supporting the mirror on a horizontal surface such as that of a table top, and a frame containing back-to-back mirror plates of different magnification factors, the frame being pivotably mounted to the base by a continuously rotatable joint and containing an internal illumination source that is effective in illuminating object fields in front of both mirror plates.

B. Description of Background Art

Certain aspects of a person's appearance are best attended to by observing a person's image in a relatively large "wide angle" mirror, which has a flat reflective surface that provides a unity or "1×" magnification. Mirrors of this type include full length wall mirrors, dresser mirrors, and bathroom mirrors mounted on a wall or cabinet. Other grooming functions such as shaving, applying cosmetics and the like are generally more easily performed while viewing a larger image of one's face, which can be obtained by positioning the face closer to a flat, non-magnifying mirror. In some circumstances, however, it is not convenient to position one's face sufficiently close to an existing flat mirror to provide an image which is sufficiently large to enable a desired personal grooming task to be easily performed. In such situations, it would be desirable to have available a magnifying mirror, i.e., a mirror having a magnification factor greater than one.

Since counter space available in locations such as bathrooms is often at a premium, it would also be desirable to have available a portable magnifying mirror which may be readily placed in a free-standing disposition on a horizontal surface, such as that of an for performing different aspects of a person's grooming, it would be desirable to have a portable free-standing mirror, which had at least two different, selectable magnifications.

A wide variety of magnifying and non-magnifying mirrors are available for personal use. However, since a person's vision generally degrades with age, there is an accompanying need for a mirror of selectable magnification which can supplement existing larger mirrors to enable a person to see image details required to perform personal care functions.

In response to a perceived need for mirrors having different magnification factors, a variety of mirrors have been disclosed which can provide more than just one magnification factor, e.g., 1× and 5×. Examples of such mirrors include the present inventor's U.S. design Pat. No. D532,981 for a Dual Magnification Table Mirror, U.S. Pat. No. 7,341,356 for a Dual Magnification Vanity Mirror Adjustable In Height And Orientation, and U.S. Pat. No. 6,854,852 for a Dual Magnification Reversible Spot Mirror Releasably Attachable To Flat Surfaces.

Dual magnification mirrors of the type described above provide a satisfactory solution to the requirement for personal mirrors having selectable magnifications. However, there are applications, such as in dimly lit rooms, where it would be desirable to have a mirror which includes an illumination source for illuminating an object such as a person's face positioned in front of the mirror. Thus, there have been disclosed a variety of mirrors which contain an illumination source, including the present inventor's U.S. Pat. No. 6,158,877 for a Magnifying Mirror Having Focused Annular Illuminator and U.S. Pat. No. 7,090,378 for a Dual Magnification Folding Travel Mirror With Annular Illuminator.

The illuminated mirrors disclosed in the foregoing patents have proved satisfactory for their intended purposes. However, there remains a need for a dual magnification mirror which has back-to-back mirrors mounted in a frame that includes an illumination source which provides substantially equal illumination of object fields located in front of either mirror, is rotatable continuously without the possibility of twisting electrical wires used to carry electrical current to the illumination source, and which is powered by batteries contained within the base of the mirror and thus not requiring a power cord for connection to power mains. The present invention was conceived of at least in part to fulfill the aforementioned needs.

OBJECTS OF THE INVENTION

An object of the present invention is to provide a mirror which has two reflective mirror plates of different magnification factors mounted back-to-back in a frame which contains an internal illumination source that is effective in providing uniform illumination of object fields in front of both mirror plates.

Another object of the invention is to provide a dual magnification mirror which includes a frame holding back-to-back mirror plates and an internal electrically energizable illumination source that is powered by batteries within a base to which the frame is pivotably mounted.

Another object of the invention is to provide an illuminated dual magnification mirror in which has a frame holding a pair of back-to-back mirror plates and an internal illumination source effective in illuminating object fields in front of both mirrors, the frame being supported by a base including a battery power source electrically connected to the illumination source though a pivot joint which enables continuous rotation of the mirror frame with respect to the base, thus enabling orientation of the mirror plates at any desired pivot angle.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a dual magnification mirror which has back-to-back mirror plates of different magnification factors and an illumination source which is effective in illuminating object fields in front of both mirror plates. According to the invention, the mirror includes a tabular base which holds therein batteries for powering the illumination source, and a support stanchion which protrudes vertically upwards from the center of the base. The mirror includes a downwardly concave, generally semi-circularly shaped mirror frame support yoke mounted onto the upper end of the stanchion. A pair of laterally inwardly facing, diametrically opposed horizontally disposed mirror frame pivot bosses protrude inwardly from opposite upper ends of the laterally opposed, quadrant-shaped left and right arms of the yoke.

According to the invention, the mirror frame support yoke has a hollow tubular construction, and includes a separate electrical power supply wire disposed downwardly through each pivot bushing and yoke arm. Lower ends of the wires meet at the lower center of the yoke, and thread through a hollow tubular passage disposed vertically through the stanchion to connect to a battery compartment and on/off switch mounted in the base of the mirror. Upper ends of the electrical power supply wires are connected to laterally outwardly located ends of a pair of left and right electrically conductive bearing cups which are inset coaxially into the pivot bosses.

In a preferred embodiment, in which the yoke and pivot bosses are made of metal, the conductive cups are mounted coaxially within cylindrical insulator bushings fitted within coaxial bores within the pivot bosses to provide electrical isolation between the conductive cups in the pivot bosses.

The mirror according to the present invention include a ring-shaped frame which holds coaxially therewithin a pair of back-to-back reflective mirror plates having different magnification factors, e.g., 1× and 5×. Each mirror plate has a relatively large diameter central reflective area and a relatively narrow, outer annular band-shaped light transmissive window area.

The outer annular ring-shaped light transmissive regions of the two back-to-back reflective mirror plates are axially aligned, and positioned radially outwardly of an annular ring-shaped illumination source located between inner facing sides of the mirror plates. In a preferred embodiment, the inner facing surface of each mirror plate has thereon a surface which specularly or diffusely reflects light emitted from the ring-shaped illumination source, thus directing light to the annular ring-shaped windows of opposed mirror plates.

According to the invention, insulated electrically conductive leads for providing electrical power to the illumination source within the mirror frame are connected to a pair of opposed pivot pins which protrude radially outwardly from laterally opposed sides of the mirror frame. The pivot pins are electrically isolated from each other and from the frame, and have convex, arcuately rounded outer transverse end faces which are of a size and shape similar to concavely rounded inner transverse end faces of the conductive bearing cups within the yoke arm bosses. The pivot pins are rotatably held within the conductive yoke arm bearing cups by resilient forces which are sufficient to insure electrical contact between each pin and cup set, and to maintain the mirror at an adjusted pivot angle relative to the yoke and base, yet enable the mirror frame to be relatively easily rotated to a desired pivot angle.

In a preferred embodiment, the resilient pivot retention force is provided by fabricating the yoke from a material which is elastically deformable in response to a radially outwardly directed tensioning force to a larger diameter to thus enable insertion of the pivot pins into the conductive cups. Removing the outward tensioning force enables the yoke arms to spring elastically inwards, thus retaining the mirror frame pivot pins within the conductive cups in the bosses at the ends of the yoke arms.

According to the invention, the annular ring-shaped illumination source is constructed in a manner that enables the mirror frame to have a substantially thinner, more aesthetically satisfying appearance than prior-art illumination mirrors which employ incandescent or fluorescent illumination sources. Thus, according to the present invention, the illumination source includes a thin, flat, annular ring-shaped printed circuit board on which are mounted a plurality of light emitting diodes (LED's). The LED's protrude radially outwards of the outer circumferential edge wall of the printed circuit board.

In an example embodiment, each LED had a cylindrically-shaped, body and a pair of conductive leads which protruded rearward from the body. Rear ends of the leads were bent at ninety degree angles and inserted into and soldered to conductive eyelets electrically continuous with a pair of conductive foil strips arranged concentrically on the pivoted circuit board.

In the example embodiment, 22 white-light emitting LEDs spaced at equal circumferential intervals of about 16 degrees were used. Each conductive foil is electrically conductively connected to a separate one of the two electrically isolated pivot pins. Thus, electrical current conveyed to the electrically conductive bearing cups in the yoke arm pivot bosses is carried through the pivot pins and thence to the LED's.

The novel design and construction of an illuminated dual magnification mirror according to the present invention provides an equally bright, uniform illumination pattern in object fields located in front of both mirror plates. Moreover, the novel design and construction of the mirror according to the present invention advantageously enables the mirror frame to be continuously rotated to thus position the 1× or 5× magnifying mirror plates at any desired angle with respect to the mirror frame support yoke, without the possibility of twisting or breaking electrical illumination wires which power the illumination source within the mirror frame.

DESCRIPTION OF THE PREFERRED EMBODIMENTS

Figure 2:
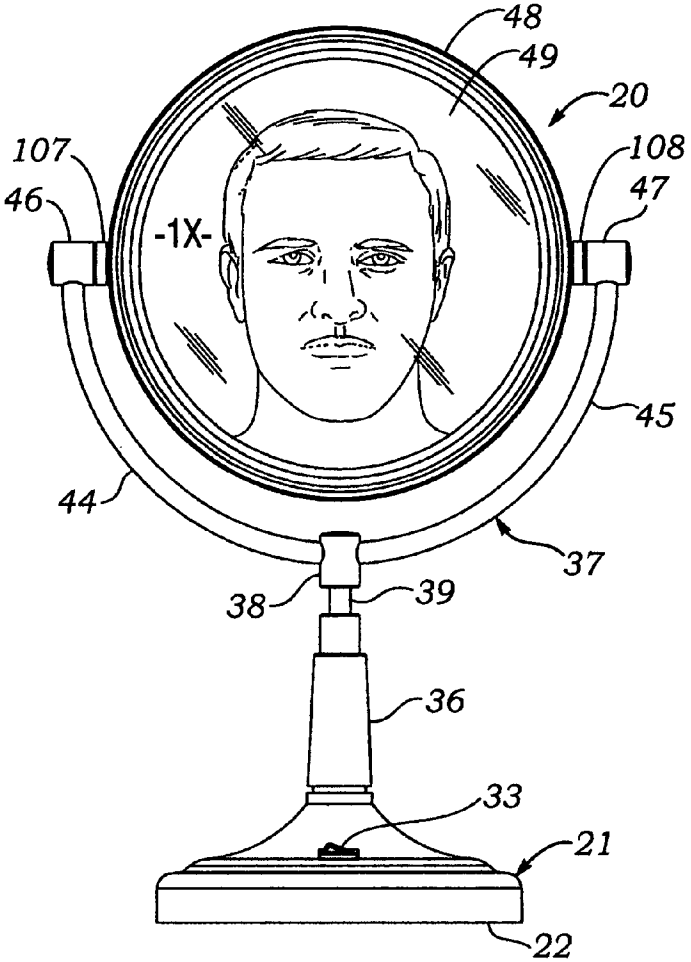
FIG. 2 is a front elevation view of an illuminated continuously rotatable dual magnification mirror according to the present invention.

FIGS. 1-13 illustrate an illuminated continuously rotatable dual magnification mirror according to the present invention.

Referring first to FIGS. 1-4, it may be seen that an illuminated continuously rotatable dual magnification mirror 20 according to the present invention includes a hollow, circularly-shaped base 21 which has a flat lower wall 22 for placement on a supporting surface such as a table top. As may be seen best by referring to FIGS. 9 and 10, base 21 has located between lower wall 22 and an upper wall 23 thereof a hollow interior space 24 which contains a battery holder 25 that is accessible via a rectangularly-shaped trap door 26 which snaps into a similarly-shaped access port 27 disposed through the lower wall 22 of the base.

Figure 9:
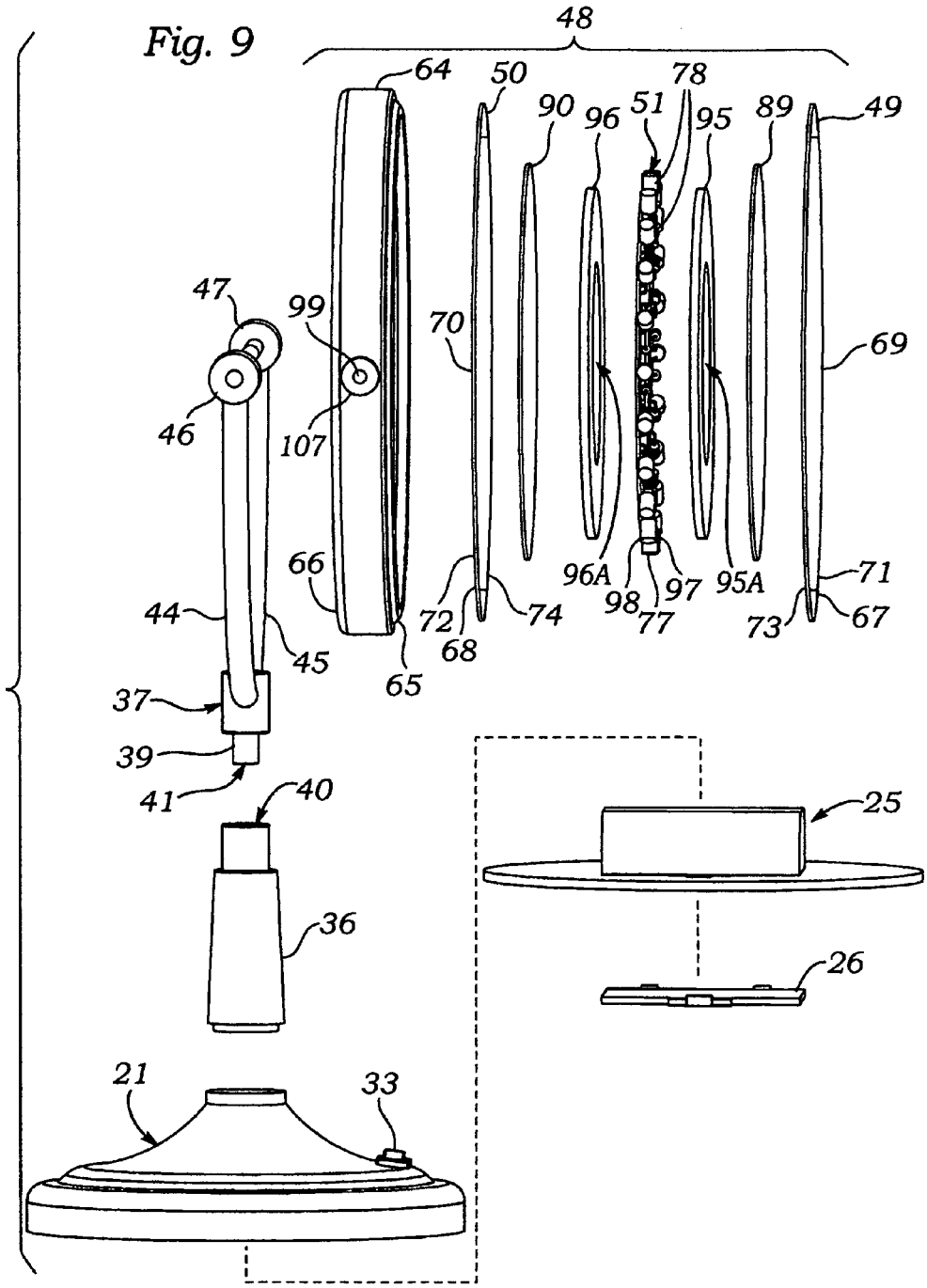
FIG. 9 is an exploded side view of the mirror of FIG. 1.
Figure 11:
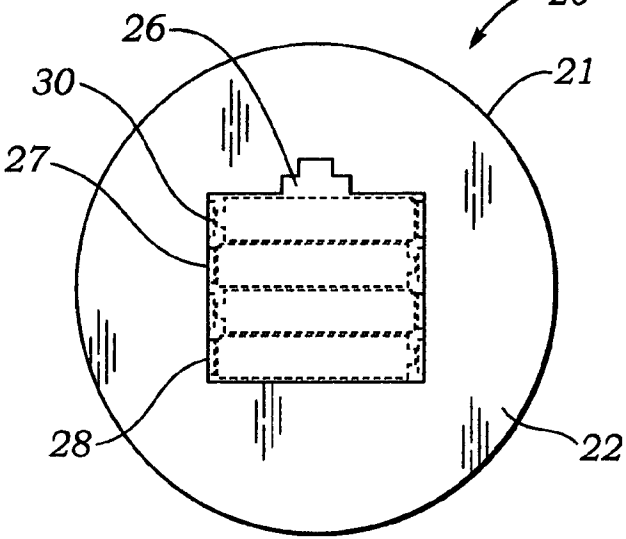
FIG. 11 is a lower plan view of the mirror of FIG. 5, showing a battery compartment cover thereof removed.

As shown in FIGS. 9 and 11, battery holder 25, which in an example embodiment was constructed to hold 4 A-A batteries connected in series, has a first, common terminal 28 to which is electrically connected a flexible insulated, common output connector lead 29. As shown in the figures, battery holder 25 also has a second output terminal 30 which is connected through an interconnect lead 31 to a first, input terminal 32 of an on/off switch 33. Switch 33 has a second, switched terminal 34 to which is connected a flexible, insulated switched power lead 35.

Referring to FIGS. 1-4, 9 and 11, it may be seen that mirror 20 includes a hollow, circular cross-section tubular stanchion 36 which protrudes upwardly from the center of upper wall 23 of base 21. As shown in the figures, upper wall 23 of base 21 has a convex, lenticular vertical transverse sectional shape, but the shape is not critical, and may, for example be flat.

Figure 1:
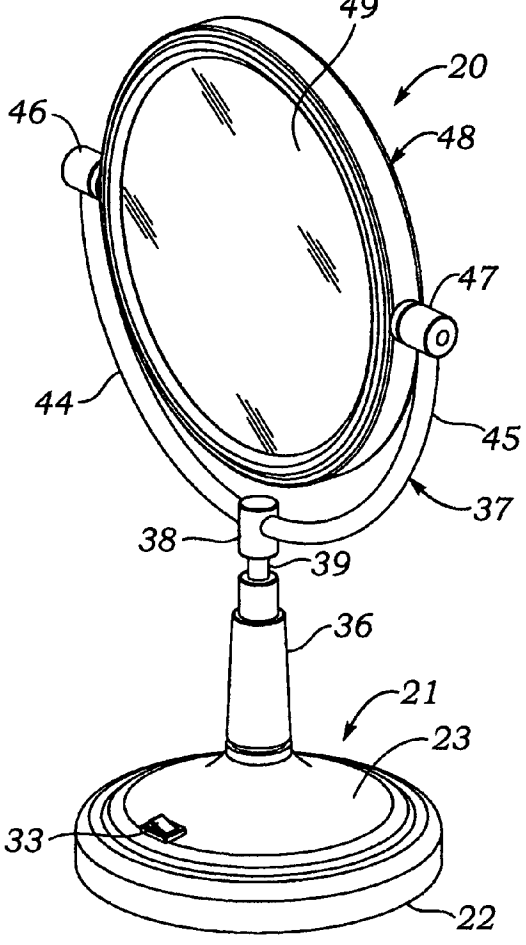
FIG. 1 is a front perspective view of an illuminated continuously rotatable dual magnification mirror according to the present invention.
Figure 4:
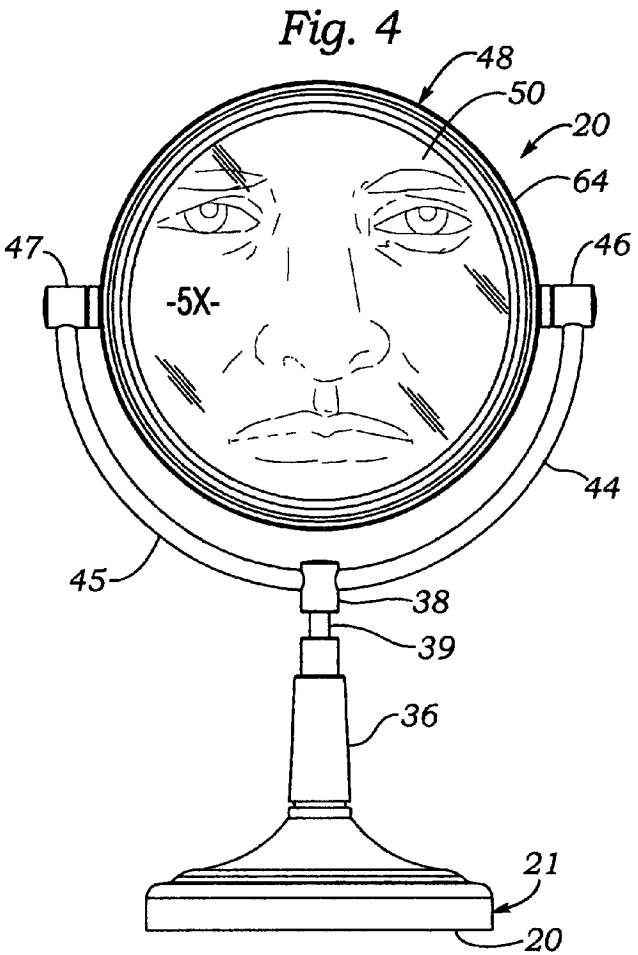
FIG. 4 is a rear elevation view of the mirror of FIG. 1, showing a rear reflective plate thereof removed.

As may be seen best by referring to FIGS. 1 and 9, mirror 20 includes a mirror frame support yoke 37 which protrudes upwardly from an upper end of the stanchion 36. As shown in the figures, yoke 37 has generally the shape of an elongated uniform circular cross-section hollow rod or tube which is curved into a downwardly concave, semicircular arc having attached to the lower central portion thereof a downwardly depending, cylindrically-shaped, vertically disposed yoke support boss 38. Yoke support boss 38 has a hollow tubular construction and has at the lower end thereof a reduced diameter neck or stem 39 which is retained within a bore 40 disposed vertically through stanchion 36.

Figure 5:
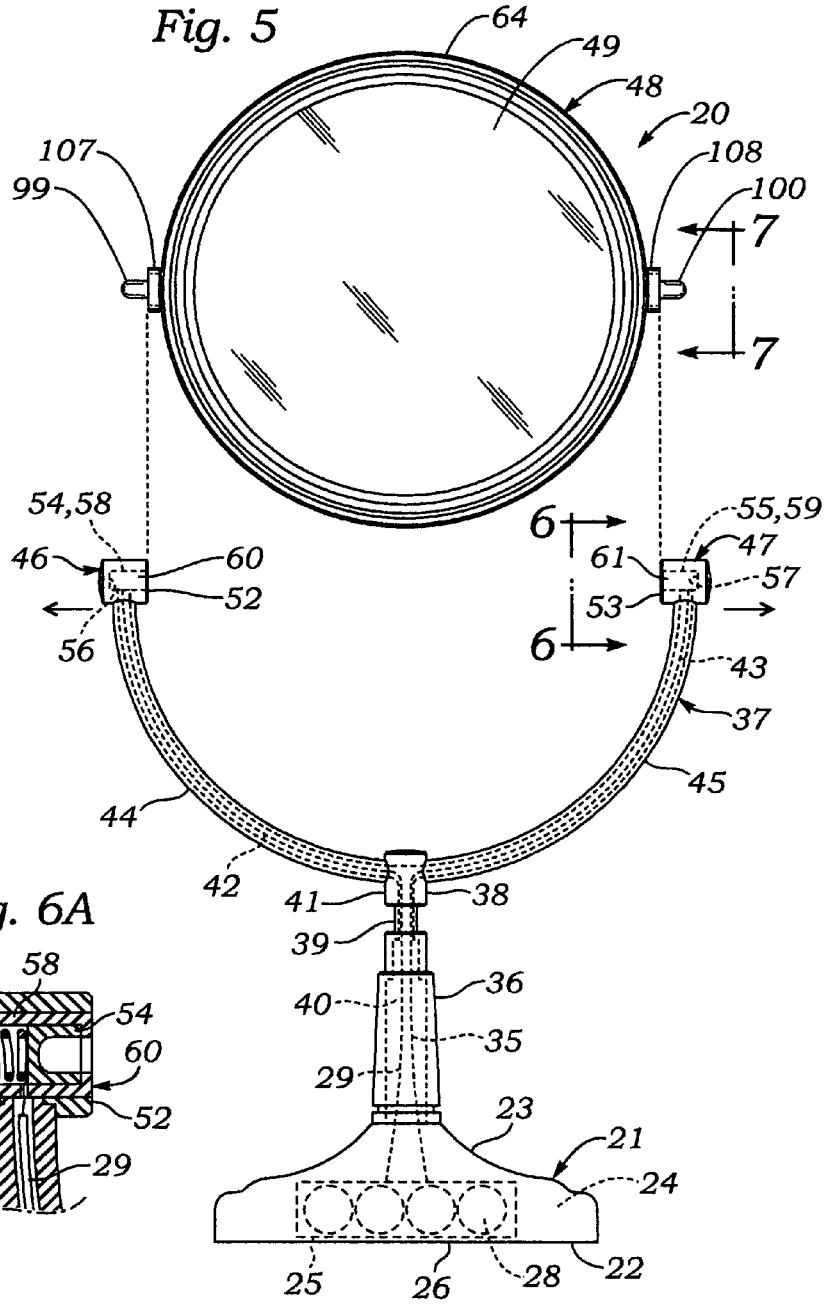
FIG. 5 is a fragmentary rear perspective view of the mirror of FIG. 4, showing a mirror housing thereof removed from the base thereof.

As may be seen best by referring to FIGS. 5 and 9, yoke support boss 38 of mirror 20 has disposed vertically therethrough a coaxial bore 41 which communicates at lower end thereof with bore 40 through stanchion 36. As is also shown in those figures, bore 41 disposed through central yoke support boss 38 communicates at an upper end thereof with a pair of left and right bores 42, 43 disposed coaxially through left and right quadrant arc-shaped arms 44, 45 of yoke 37.

Figure 6A:
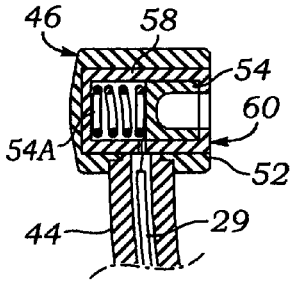
FIG. 6A is a fragmentary vertical sectional view of a left-hand boss of the mirror of FIG. 5.
Figure 7:
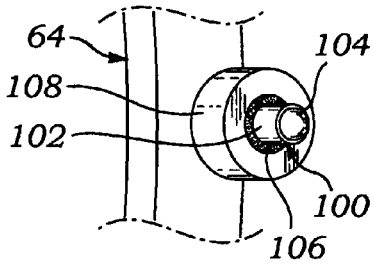
FIG. 7 is a fragmentary outer side elevation view of the mirror housing of FIG. 5, taken in the direction 7-7.
Figure 6:
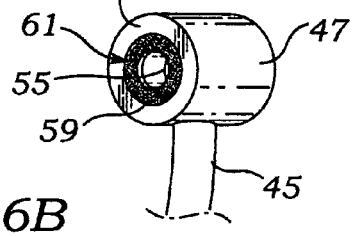
FIG. 6 is a fragmentary inner side elevation view of the mirror of FIG. 5, taken in the direction 6-6.
Figure 8:
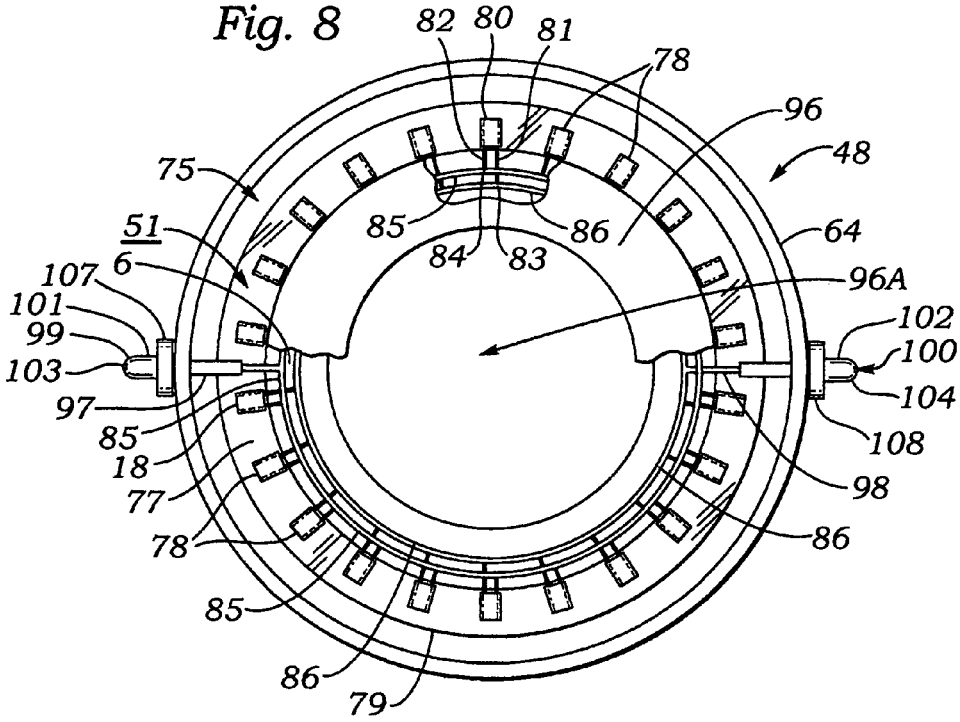
FIG. 8 is a fragmentary view of the mirror of FIG. 5, showing a rear reflective plate thereof removed from the housing.

Referring to FIGS. 5, 6 and 9, it may be seen that mirror 20 includes a pair of left and right pivot support bosses 46, 47 located at upper ends of left and right yoke arms 44, 45 respectively. Bosses 46, 47 rotatably support a mirror assembly 48 which holds a pair of back-to-back mirror plates 49, 50 having different magnification factors, e.g., 1× and 5×. As shown in FIGS. 8 and 9, mirror frame 48 has therewithin an illumination source 51 which is effective in illuminating object fields in front of both mirror plates 49, 50. The structural and functional details of mirror 20 which enable pivot support bosses 46, 47 to continuously rotatably support mirror assembly 48 while supplying electrical power to illumination source 51 are described below.

Referring to FIGS. 5-9, it may be seen that left and right frame pivot support bosses 46, 47 are of similar construction, each having extending axially from an inner transverse end face 52, 53 thereof a coaxial conductive bearing cup 54, 55, respectively. As shown in the figures, each bearing cup 54, 55 has a generally tubular cylindrical shape which is terminated at a transverse end thereof by a concave, generally hemispherically shaped end wall 56, 57, respectively. Each bearing cup 54, 55 is made of an electrically conductive material, and is in electrically conductive contact with a separate insulated electrical power lead, i.e., common power lead 29 and switched power lead 35.

As shown in FIG. 5, common power lead 29 and switched power lead 35 are disposed upwardly from battery holder 25 and switch 33 in the hollow interior space 24 of base 21, through bore 40 through stanchion 36 and bore 41 through yoke support boss 38. Power leads 29, 35 extending upward from bore 41 through yoke support boss 38 are routed separately through bore 42 through left-hand yoke arm 44 to connect an electrically conductive contact with left-hand bearing cup 54, and through bore 43 through right-hand yoke arm 45 to connect in electrically conductive contact with right-hand bearing cup 55.

Figure 6B:
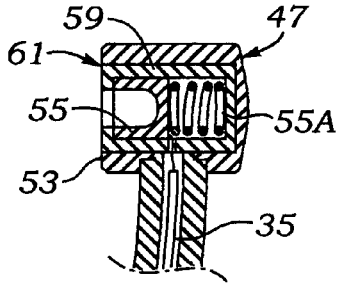
FIG. 6B is a fragmentary vertical sectional view of a right-hand boss of the mirror of FIG. 5.

In a preferred embodiment of mirror 20, yoke 37 and pivot support bosses 46, 47 are made of metal. With this construction, structure must be provided to prevent the metal yoke arms from forming a short circuit between electrically conductive bearing cups 54, 55. Thus, as shown in FIGS. 5 and 6, the conductive bearing cups 54, 55 are mounted coaxially within hollow cylindrically-shaped insulator bushings 58, 59 fitted within coaxial bores 60, 61 which extend inwards into pivot support bosses 46, 47 from transverse faces 52, 53 thereof. As may be seen best by referring to FIGS. 6A and 6B, an inner transverse end of each bearing cup, such as bearing cup 54, is urged resiliently outwards within its supporting boss 46 by a compression spring 54A.

The structure of mirror assembly 48, and its functional interaction with other components of mirror 20, may be best understood by referring to FIGS. 1-10.

Referring now to FIGS. 5-10, it may be seen that mirror assembly 48 includes an annular ring-shaped frame 64. As shown in FIGS. 2, 4 and 5-10, frame 64 has inwardly protruding front and rear annular peripheral flanges 65, 66, respective, which bear against front and rear peripheral edges 67, 68 of front and rear mirror plates 49, 50 to retain the mirror plates within the frame.

As may be seen best by referring to FIGS. 1,4, 8, 9 and 10, front and rear mirror plates 49, 50 are circularly-shaped and have central outwardly facing circularly reflective surfaces 69, 70, respectively, which occupy a substantially large portion of the diameter of the mirror plates. As is also shown in the figures, front and rear mirror plates 49, 50 have narrow outer peripheral annular ring-shaped window bands 71, 72 which encircle the central reflective surfaces 69, 70, respectively. Window bands 71, 72 are light transmissive, and preferably made of a transparent material which has a frosted inner facing surfaces 73, 74 so that light passing through the window bands is diffused. Also, as shown in FIG. 9, inner surfaces 73, 74 of diffusely transmitting of bands 71, 72 have a beveled shape, so that the outer circumferential edges of the bands are thinner than the inner circumferential edges of the bands.

Figure 10:
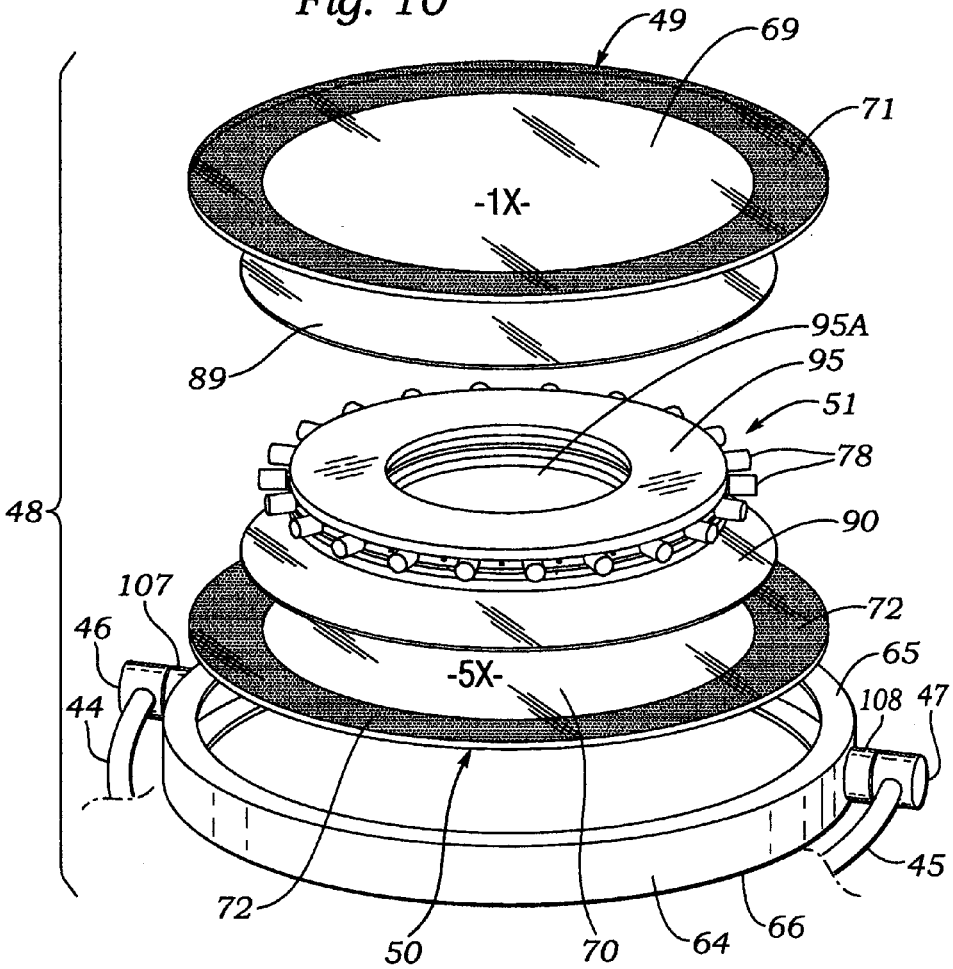
FIG. 10 is a fragmentary exploded perspective view of the mirror of FIG. 1, showing another view of a mirror assembly thereof.
Figure 12:
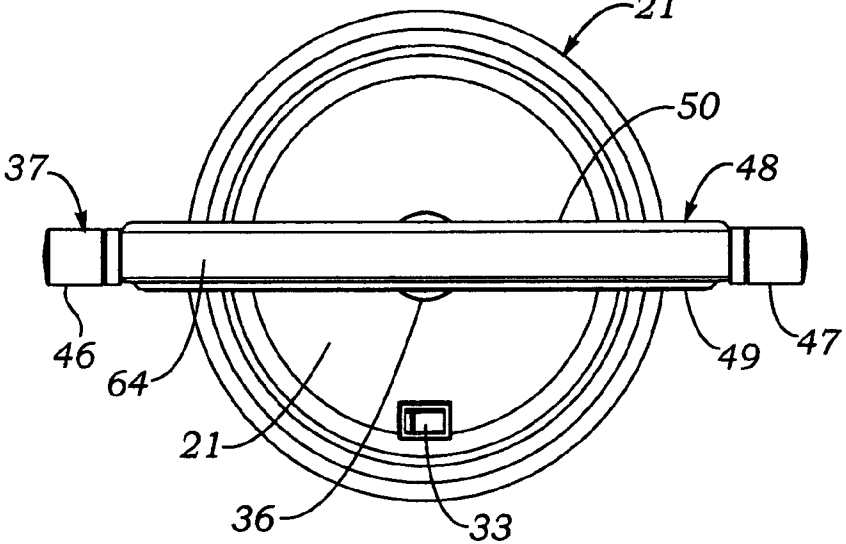
FIG. 12 is an upper plan view of the mirror of FIG. 1.

Referring to FIGS. 8-10, it may be seen that frame 64 of mirror assembly 48 has a circular disk-shaped interior space 75 which has therewithin a circular disk-shaped annular ring-shaped printed circuit board 77. Printed circuit board 77 has mounted thereto a plurality of white-light emitting diodes (LED's) 78 which protrude radially outwardly of the outer circular circumferential edge wall 79 of the printed circuit board. In an example embodiment of mirror 20, each LED 78 had a cylindrically-shaped body 80, and a pair of conductive leads 81, 82 which protruded rearwardly from the body. Rear ends of conductive leads 81, 82 were bent at ninety degree angles relative to front portions of the leads, and inserted into and soldered to electrically conductive eyelets 83, 84 which were electrically continuous with a pair of outer and inner circular ring-shaped conductive foils 85, 86 arranged concentrically on printed circuit board 77. In the example embodiment 22 white-light emitting diodes 78 spaced at equal circumferential intervals of about 16 degrees were used.

Referring to FIGS. 8 and 10, it may be seen that inner facing central circular portions of mirror plates 49, 50 preferably have reflective surfaces 89, 90. The function of the inner facing reflective surfaces is to reflect light emitted by LED's 78 obliquely towards opposite window bands 72, 71, thus increasing the illumination intensity of objects in front of mirror plates 49, 50. To increase the transfer efficiency of light emitted by LED's 78 through annular mirror window ands 71, 72, outer annular edge portions 91, 92 of reflective surfaces 89, 90 are preferably angled in the same sense as the beveled inner annular edges of mirror plates 49, 50. In an example embodiment of mirror 20, reflective surfaces 89, 90 consisted of thin circular sheets of specularly reflective aluminized Mylar adhered to inner facing surfaces 93, 94 of front and rear mirror plates 49, 50.

Referring still to FIGS. 8-10, it may be seen that mirror assembly 48 includes a pair of front and rear circular disk-shaped insulating spacers 95, 96 which are adhered to front and rear surfaces 97, 98, respectively of printed circuit board 77. Spacers 95, 96, which may for example be made of a foam board, i.e., a thin sheet of pasteboard to which is laminated a thicker lamination made of a high density polymer foam, preferably have central apertures 95A, 96A for providing clearance for inner surfaces of mirror plates 49, 50.

Figure 13:
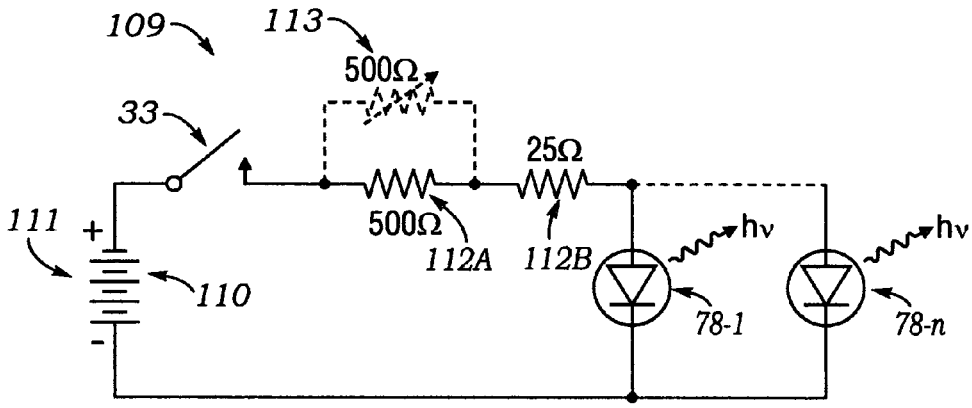
FIG. 13 is an electrical schematic diagram of the mirror of FIG. 1.

As may be seen best by referring to FIGS. 8, 10 and 13, LED's 78 are wired in parallel to conductive foils 85, 86 on printed circuit board 77. Also, conductive foils 85, 86 are connected by wires 97, 98 to a pair of horizontally disposed electrically conductive pivot pins 99, 100 which protrude radially outwardly from opposite sides of mirror frame 64. As may be seen best by referring to FIGS. 6 and 8, pivot pins 99, 100 have a generally cylindrical body 101, 102 and an outer transverse end face 103, 104 which has a convex, arcuately curved shape similar to that of the concave inner end walls 56, 57 of pivot support bearing cups 54, 55. As shown in FIGS. 6 and 8, pivot pins 99, 100 are electrically isolated from frame 64 by coaxial insulated bushings 105, 106, respectively, which protrude from bosses 107, 108 that protrude laterally outwards from opposite sides of the frame. With this construction, applying radially outwardly directed tension forces to left and right yoke arms 44, 45 of mirror 26, as shown in FIG. 5, enables mirror assemble 48 to be inserted downwardly into the yoke, until left and right pivot pins 99, 100 are axially aligned with left and right bearing cups 54, 55, respectively. Removing the tensioning forces causes the elastically deformed yoke arms 44, 45 to move radially inwards, thus rotatably retaining the pins within their respective bearing support cups.

FIG. 13 is an electrical schematic diagram of electrical circuitry 109 of mirror 20. As shown in FIG. 13, circuitry 109 includes a battery power supply 110 containing for example, 4 A-A batteries 111 connected in series. Circuitry 109 includes ballast resistors 112A, 112B in series with battery power supply 110 and LED's 78, to limit current through the LED's to a predetermined value. Optionally, a fixed ballast resistor 112A may be replaced with a rheostat or potentiometer 113 which has a manually variable resistance, thus enabling adjustability of the current through and hence light output from LED's 78.

Figure 3:
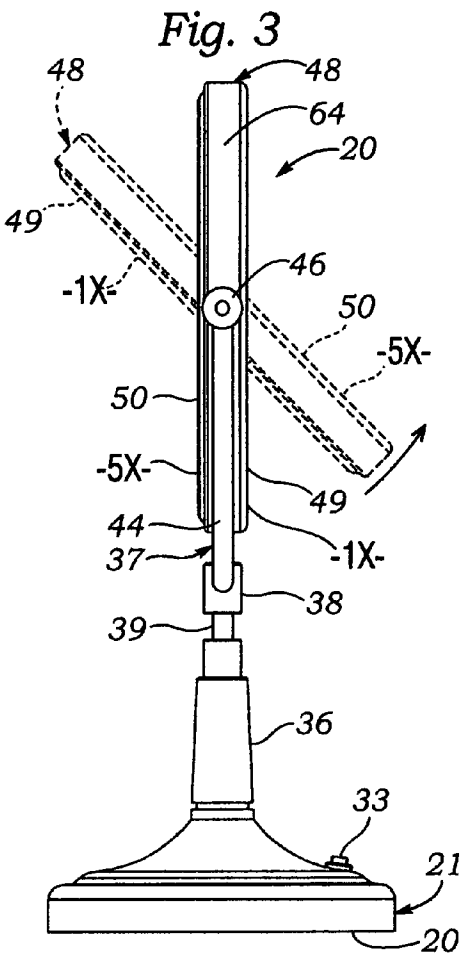
FIG. 3 is a side elevation view of the mirror of FIG. 1.
Figure 9A:
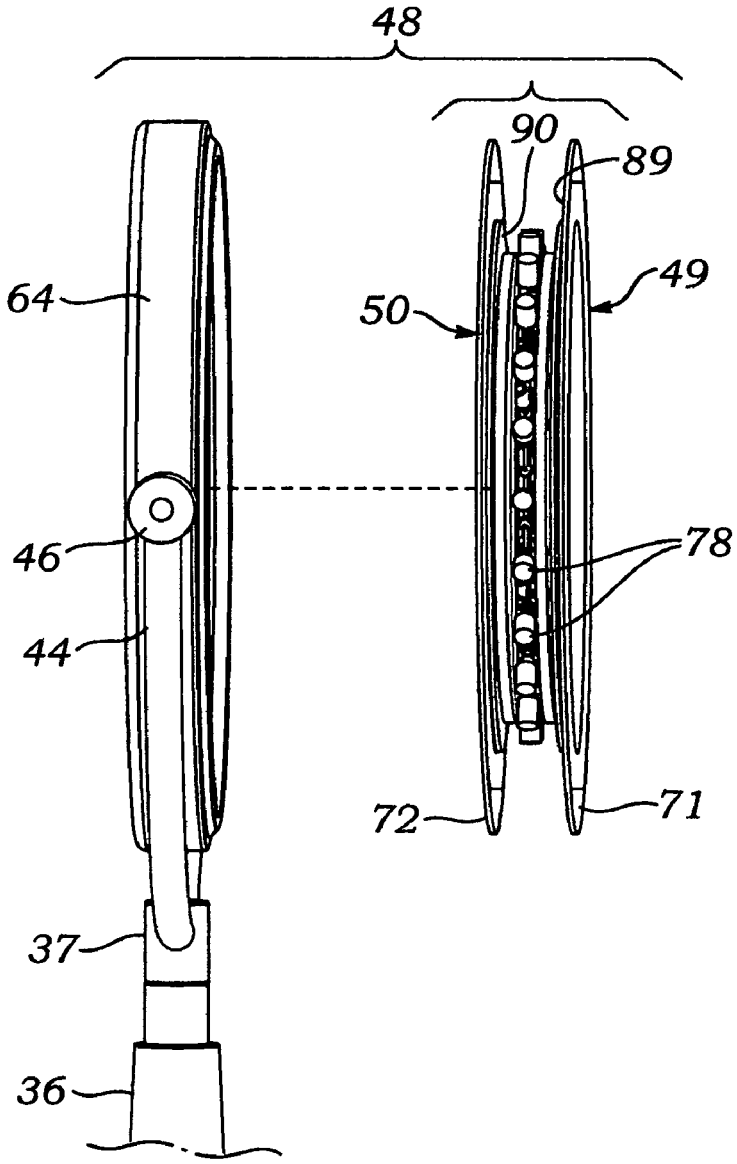
FIG. 9A is a view similar to that of FIG. 9, but showing a mirror assembly thereof in assembled form.

As may be best understood by referring to FIGS. 3 and 9A, the use of an annular ring-shaped arrangement of radially disposed LED's 78 as an internal illumination source for mirror 20 enables mirror assembly 48 to have a minimum thickness, scarcely more than that of a non-illuminated mirror using a pair of back-to-back concave and flat mirror plates. Thus, the novel construction of mirror 20 enables it to have a more compact, space and materials conserving envelope than prior art illuminated mirrors.

Also, as shown in FIG. 9A, the arrangement of radially oriented LED's 78 in an annular ring-shaped configuration according to the present invention facilitates positioning the LED's at an optimum distance from the inner edge of the peripheral light transmissive window bands 71, 72 of mirror 20, such that light rays emitted rearward from LED's 78 are reflected forwards from rear inner reflective surface 90 through front window band 71, and rays emitted forward from the LED's are reflected rearwards from front inner reflective surface 89 through rear window band 72.

What is claimed is:

1. A mirror comprising;

a. a mirror assembly including a mirror frame holding therein at least a first imaging reflective mirror plate, said first reflective mirror plate having an axially outwardly facing imaging light reflective surface and a light transmissive region adjacent to said light reflective surface, b. an electrically energizable illumination source located within said frame axially inwardly of said light transmissive region of said first reflective mirror plate, c. a yoke having a pair of opposed arms for rotatably supporting therebetween said mirror frame, and d. an electrical power coupling mechanism for providing electrical power to said illumination source, said electrical power coupling mechanism including a pair of laterally opposed continuously rotatable electrically conductive pivot joints, each of said continuously rotatable electrically conductive pivot joints comprising in combination an electrically conductive pin which protrudes from one of said frame and a said yoke arm, an electrically conductive cup which rotatably supports said pin located in the other of said yoke arm and said frame, an electrical conductor disposed between one of said pin and cup and said illumination source, and an electrical conductor disposed between the other end of said cup and said pin and an output terminal of an electrical power source.

2. The mirror of claim 1 wherein said illumination source is further defined as being effective in emitting light rays towards said first reflective mirror plate.

3. The mirror of claim 2 further including a second imaging reflective mirror plate having a central axially outwardly facing imaging light reflective surface and a light transmissive region adjacent to said imaging light reflective surface, said second mirror plate being located on a side of said illumination source axially opposed to that of said first reflective mirror plate.

4. The mirror of claim 3 wherein said illumination source is further defined as being effective in emitting light rays towards said second reflective mirror plate.

5. The mirror of claim 4 further including electrical conductors within said yoke arms for conducting electrical power from a power source to said yoke arm connectors.

6. The mirror of claim 5 further including an electrical power source located within a base of said mirror for powering said illumination source.

7. The mirror of claim 6 further including a hollow stanchion disposed between said base and said yoke.

8. The mirror of claim 7 wherein said electrical conductors for conducting electrical power to said yoke arm connectors are further defined as comprising first and second conductors disposed through said stanchion and said first and second yoke arms, respectively.

9. A mirror comprising:

a. a mirror assembly including a mirror frame holding therein at least a first imaging light reflective mirror plate, said first reflective mirror plate having a central axially outwardly facing imaging reflective surface and a light transmissive region adjacent to said imaging reflective surface, b. an electrically energizable illumination source located within said frame axially inwardly of an axially inner facing side of said reflective mirror plate, said illumination source having light emitting regions effective in directing light rays through said light transmissive regions of said first reflective mirror plate, c. a yoke having a pair of opposed arms for rotatably supporting therebetween said mirror frame, d. an electrical power coupling mechanism for providing electrical power to said illumination source, said electrical power coupling mechanism including a pair of laterally opposed continuously rotatable electrically conductive pivot joints, each of which comprises in combination an electrically conductive pin that protrudes from one of said frame and a said yoke arm, an electrically conductive cup which supports said pin located in the other of said yoke and said frame, an internal electrical conductor disposed between one of said pin and cup and said illumination source, and an external electrical conductor disposed between the other of said cup and said pin and through a said yoke arm towards an output terminal of an electrical power source, e. a support base containing therein an electrical power supply, and f. a support structure disposed between said base and said yoke, said support structure having disposed therein a hollow tubular passageway for receiving therethrough a first external electrical conductor through said first yoke arm and a second external electrical conductor through said second yoke arm, said first and second external conductors being electrically conductively connectable to first and second output terminalis of said power supply.

10. The mirror of claim 9 wherein said light emitting regions of said illumination source are further defined as being at least in part generally concentrically aligned with said light transmissive region of said first reflective mirror plate.

11. The mirror of claim 10 wherein said light transmissive region of said first reflective mirror plate is further defined as having the shape of an annular ring-shaped band which circumscribes said imaging reflective surface of said first reflective mirror plate.

12. The mirror of claim 11 wherein said light emitting regions of said illumination source are further defined as lying on a transversely disposed annular ring-shaped band on a support member, said band being concentric with said light transmissive region of said first reflective mirror plate and located axially inwards of said first reflective mirror plate.

13. The mirror of claim 12 wherein said light emitting regions of said illumination source are further defined as being located in a plurality of light emitting diodes arranged in circumferentially spaced apart locations adjacent to an outer peripheral edge of said ring-shaped band.

14. The mirror of claim 12 wherein said support member is further defined as including a ring-shaped printed circuit board on which are mounted said plurality of light emitting diodes, at least parts of which protrude radially outwards of an outer peripheral edge of said printed circuit board.

15. The mirror of claim 14 further including a first light reflective member located axially inwardly of said illumination source, said first reflective member having a light reflective surface facing said light transmissive region of said first reflective mirror plate.

16. The mirror of claim 15 wherein said light transmissive region of said first mirror plate is further defined as being radially outwardly beveled whereby radially outwardly located portions of said light transmissive region are thinner than a radially inwardly located portion thereof.

17. The mirror of claim 15 wherein said light transmissive region of said first reflective mirror plate is further defined as having a diffusive light transmittance.

18. The mirror of claim 9 further including a second reflective mirror plate having a central axially outwardly facing imaging reflective surface and a light transmissive region adjacent to said imaging reflective surface, said second reflective mirror plate having an axially inwardly facing inner surface.

19. The mirror of claim 8 wherein said first light reflective member is located on a reverse, axially inwardly located surface of said second reflective mirror plate.

20. The mirror of claim 19 further including a second light reflective member located axially inwardly of said illumination source, said second light reflective member having a light reflective surface facing said light transmissive region of said second reflective mirror plate.

21. The mirror of claim 20 wherein said second light reflective member is located on a reverse, axially inwardly located surface of said first reflective mirror plate.

22. A mirror comprising;

a. a mirror assembly including a mirror frame holding therein at least a first imaging reflective mirror plate, said first reflective mirror plate having an axially outwardly facing imaging light reflective surface and a light transmissive region adjacent to said light reflective surface, b. an electrically energizable illumination source located within said frame axially inwardly of said light transmissive region of said first reflective mirror plate, c. a yoke having a pair of opposed support arms for rotatably supporting therebetween said mirror frame, and d. an electrical power coupling mechanism for providing electrical power to said illumination source through said yoke arms, said electrical power coupling mechanism including at least a first continuously rotatable electrically conductive pivot joint disposed between a first side of said mirror frame and a first one of said pair of opposed support arms.

23. The mirror of claim 22 further including a second continuously rotatable electrically conductive pivot joint disposed between a second side of the mirror frame laterally opposed to said first side of said mirror frame and a second one of said pair of opposed support arms.

* * * * *